US006466904B1

(12) United States Patent
Gao et al.

(10) Patent No.: US 6,466,904 B1
(45) Date of Patent: Oct. 15, 2002

(54) METHOD AND APPARATUS USING HARMONIC MODELING IN AN IMPROVED SPEECH DECODER

(75) Inventors: Yang Gao, Mission Viejo, CA (US); Huan-yu Su, San Clementa, CA (US)

(73) Assignee: Conexant Systems, Inc., Newport Beach, CA (US)

( * ) Notice: Subject to any disclaimer, the term of this patent is extended or adjusted under 35 U.S.C. 154(b) by 216 days.

(21) Appl. No.: 09/624,187

(22) Filed: Jul. 25, 2000

(51) Int. Cl.[7] ..... G10L 19/00

(52) U.S. Cl. ..... 704/220; 704/225; 704/206; 704/208

(58) Field of Search ..... 704/206, 220, 704/205, 225, 208

(56) References Cited

U.S. PATENT DOCUMENTS 5,701,390 A * 12/1997 Griffin et al. ..... 704/206
5,754,974 A * 5/1998 Griffin et al. ..... 704/206
5,890,115 A * 3/1999 Cole ..... 704/258
5,907,822 A * 5/1999 Prieto, Jr. ..... 704/202
5,946,651 A * 8/1999 Jarvinen et al. ..... 704/223
6,029,128 A * 2/2000 Jarvinen et al. ..... 704/220
6,233,550 B1 * 5/2001 Gersho et al. ..... 704/208
6,377,915 B1 * 4/2002 Sasaki ..... 704/206
6,418,408 B1 * 7/2002 Bhaskar et al. ..... 704/219

* cited by examiner

*Primary Examiner*—Susan McFadden
(74) *Attorney, Agent, or Firm*—Farjami & Farjami LLP

(57) ABSTRACT

There is provided a speech decoder comprising a means for generating an excitation signal and a means for performing harmonic analysis and synthesis on the excitation signal in order to generate a smooth, periodic speech signal. The speech decoder further comprises a mixing means for mixing the excitation signal with the smooth, periodic signal and a synthesizing means for synthesizing the modified excitation signal into a speech signal that can be played to a user through a listening means. There is also provided a receiver that incorporates a speech decoder such as the decoder described above as well as a method for speech decoding.

18 Claims, 8 Drawing Sheets

METHOD AND APPARATUS USING HARMONIC MODELING IN AN IMPROVED SPEECH DECODER

FIELD OF THE INVENTION

The present invention relates generally to digital voice decoding and, more particularly, to a method and apparatus for using harmonic modeling in an improved speech decoder.

BACKGROUND OF THE INVENTION

A general diagram of a CELP encoder 100 is shown in FIG. 1 A. A CELP encoder uses a model of the human vocal tract in order to reproduce a speech input signal. The parameters for the model are actually extracted from the speech signal being reproduced, and it is these parameters that are sent to a decoder 112, which is illustrated in FIG. 1A. Decoder 112 uses the parameters in order to reproduce the speech signal. Referring to FIG. 1A, synthesis filter 104 is a linear predictive filter and serves as the vocal tract model for CELP encoder 100. Synthesis filter 104 takes an input excitation signal $\mu(n)$ and synthesizes a speech signal s(n) by modeling the correlations introduced into speech by the vocal tract and applying them to the excitation signal $\mu(n)$.

In CELP encoder 100 speech is broken up into frames, usually 20 ms each, and parameters for synthesis filter 104 are determined for each frame. Once the parameters are determined, an excitation signal $\mu(n)$ is chosen for that frame. The excitation signal is then synthesized, producing a synthesized speech signal s'(n). The synthesized frame s'(n) is then compared to the actual speech input frame s(n) and a difference or error signal e(n) is generated by subtractor 106. The subtraction function is typically accomplished via an adder or similar functional component as those skilled in the art will be aware. Actually, excitation signal $\mu(n)$ is generated from a predetermined set of possible signals by excitation generator 102. In CELP encoder 100, all possible signals in the predetermined set are tried in order to find the one that produces the smallest error signal e(n). Once this particular excitation signal $\mu(n)$ is found, the signal and the corresponding filter parameters are sent to decoder 112 (FIG. 1B), which reproduces the synthesized speech signal s'(n). Signal s'(n) is reproduced in decoder 112 by using an excitation signal $\mu(n)$, as generated by decoder excitation generator 114, and synthesizing it using decoder synthesis filter 116.

By choosing the excitation signal that produces the smallest error signal e(n), a very good approximation of speech inputs(n) can be reproduced in decoder 112. The spectrum of error signal e(n), however, will be very flat, as illustrated by curve 204 in FIG. 2. The flatness can create problems in that the signal-to-noise ratio (SNR), with regard to synthesized speech signal s'(n) (curve 202), may become too small for effective reproduction of speech signal s(n). This problem is especially prevalent in the higher frequencies where, as illustrated in FIG. 2, there is typically less energy in the spectrum of s'(n). In order to combat this problem, CELP encoder 100 includes a feedback path that incorporates error weighting filter 108. The function of error weighting filter 108 is to shape the spectrum of error signal e(n) so that the noise spectrum is concentrated in areas of high voice content. In effect, the shape of the noise spectrum associated with the weighted error signal $e_w(n)$ tracks the spectrum of the synthesized speech signal s'(n), as illustrated in FIG. 2 by curve 206. In this manner, the SNR is improved and the quality of the reproduced speech is increased.

In encoder 100 and decoder 112, the vocal tract model works by assuming that speech signal s(n) remains constant for short periods of time. Speech signal s(n) is not constant, however, and because speech signal s(n) (curve 302 in FIG. 3) is actually changing all the time, noise is induced in the quantized speech signal $\mu(n)$. As a result, the spectrum (curve 304 in FIG. 3) for quantized speech signal $\mu(n)$ is not as smooth or periodic as the spectrum for speech signal s(n). The result is that synthesized speech signal s'(n) (curve 306 in FIG. 3), in decoder 112, produces noisy speech that does not sound as good as the actual speech signal s(n). Ideally, the synthesized speech would sound very close to the actual speech, and thus provide a good listening experience.

SUMMARY OF THE INVENTION

There is provided a speech decoder comprising a means for generating an excitation signal and a means for performing harmonic analysis and synthesis on the excitation signal in order to generate a smooth, periodic speech signal. The speech decoder further comprises a mixing means for mixing the excitation signal with the smooth, periodic signal and a synthesizing means for synthesizing the modified excitation signal into a speech signal that can be played to a user through a listening means.

There is also provided a receiver that incorporates a speech decoder such as the decoder described above as well as a method for speech decoding. These and other embodiments as well as further features and advantages of the invention are described in detail below.

BRIEF DESCRIPTION OF THE DRAWINGS

In the figures of the accompanying drawings, like reference numbers correspond to like elements, in which.

DETAILED DESCRIPTION OF PREFERRED EMBODIMENTS

Figure 4:
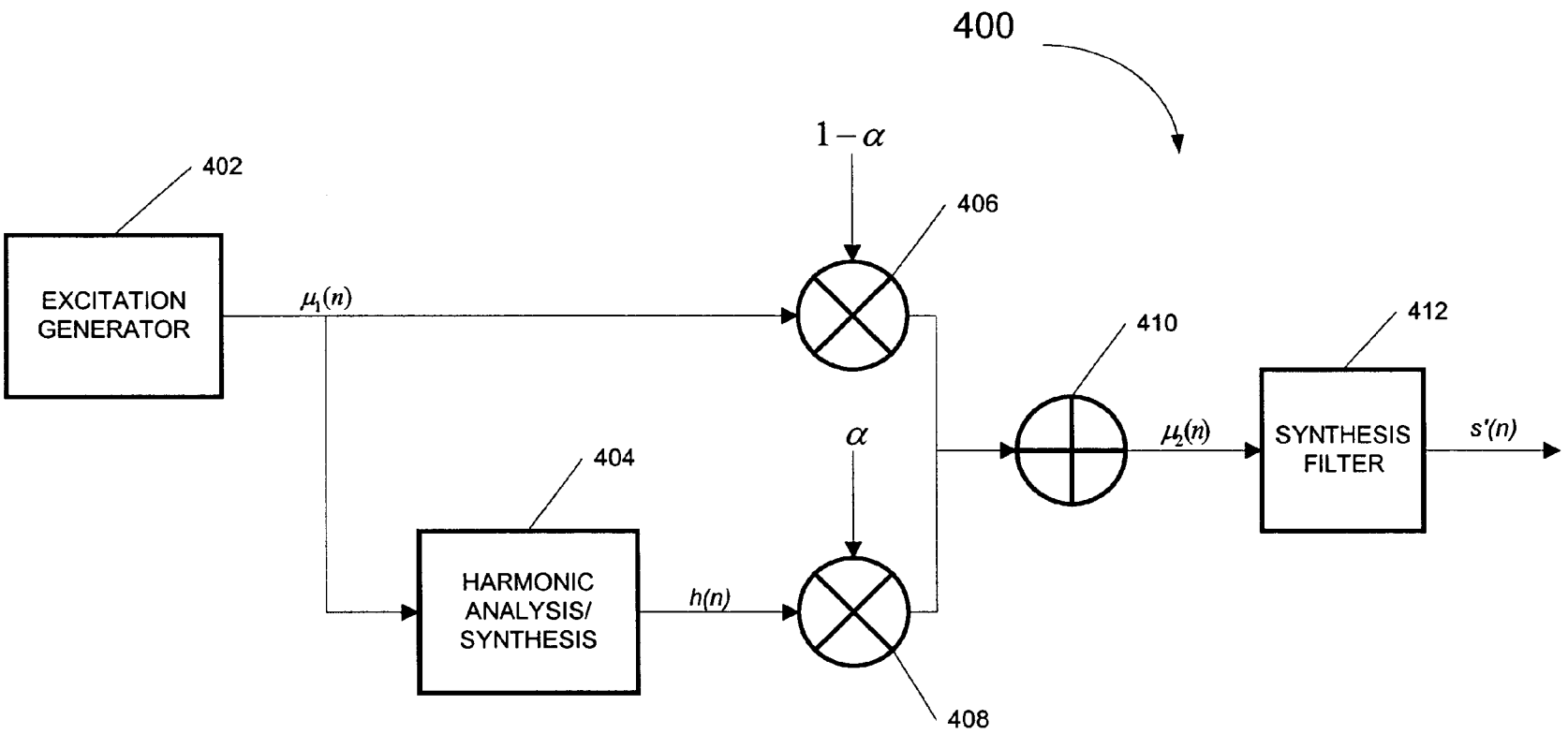
FIG. 4 is a block diagram illustrating a speech decoder in accordance with the invention.

FIG. 4 illustrates an example embodiment of a speech decoder 400 in accordance with the invention. Speech decoder 400 comprises an excitation generator 402 and a harmonic analysis and synthesis filter 404. Excitation generator 402 generates an excitation signal $\mu_1(n)$. Excitation signal $\mu_1(n)$ is the input to the harmonic analysis and synthesis filter 404, which produces a smooth, periodic speech signal h(n). Periodic speech signal h(n) is multiplied by a first gain factor ($\alpha$) in multiplier 408, where ($\alpha$) is between 1 and 0. Excitation signal $\mu_1(n)$ is multiplied by a second gain factor ($1-\alpha$) in multiplier 406. The outputs of multipliers 406 and 408 are then combined in adder 410, producing a modified excitation signal $\mu_2(n)$. Modified excitation signal $\mu_2(n)$ is the input to synthesis filter 412, which produces synthesized speech signal s'(n).

Figure 3:
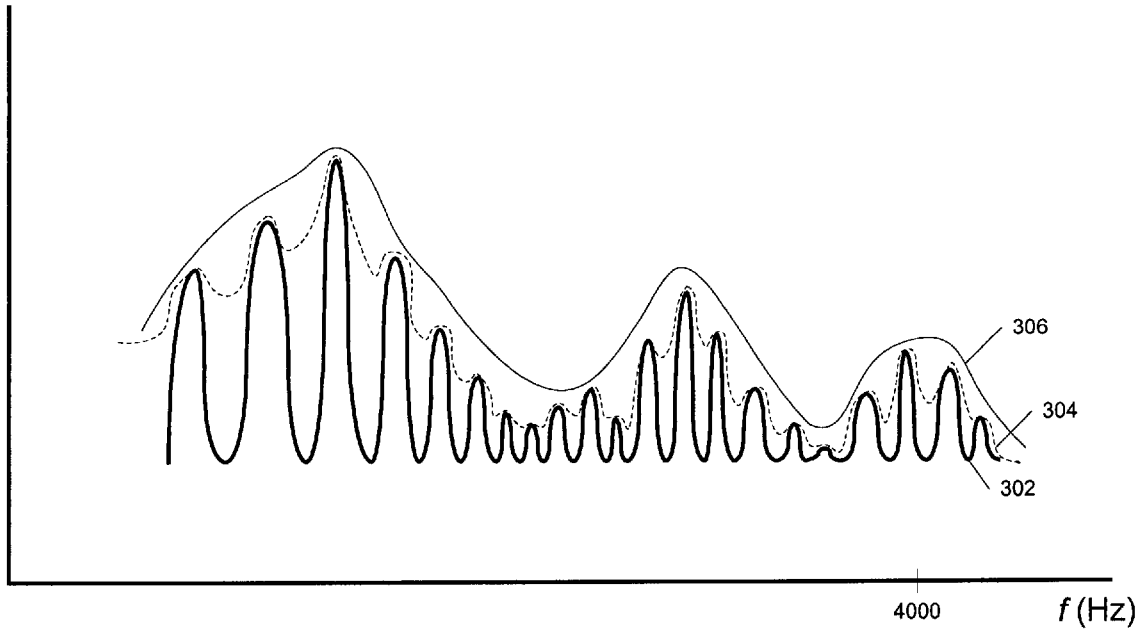
FIG. 3 is a graph illustrating the relationship between an input speech signal, a quantized speech signal and a synthesized speech signal in the decoder illustrated in FIG 1B.
Figure 5:
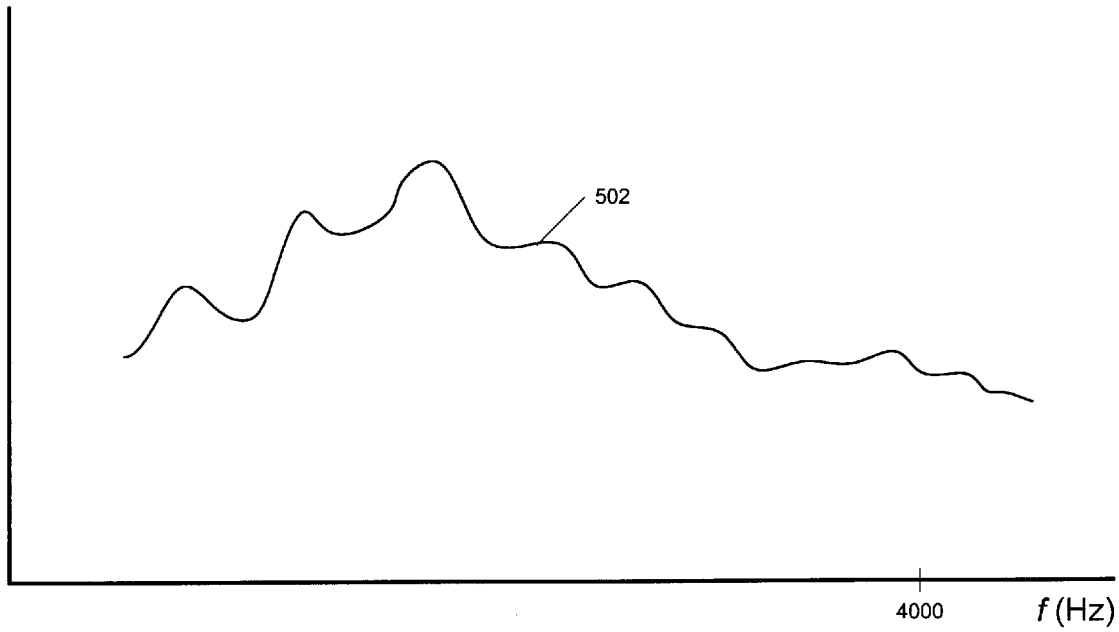
FIG. 5 is a graph illustrating the energy spectrum of a quantized speech signal in the decoder illustrated in FIG. 4.
Figure 6:
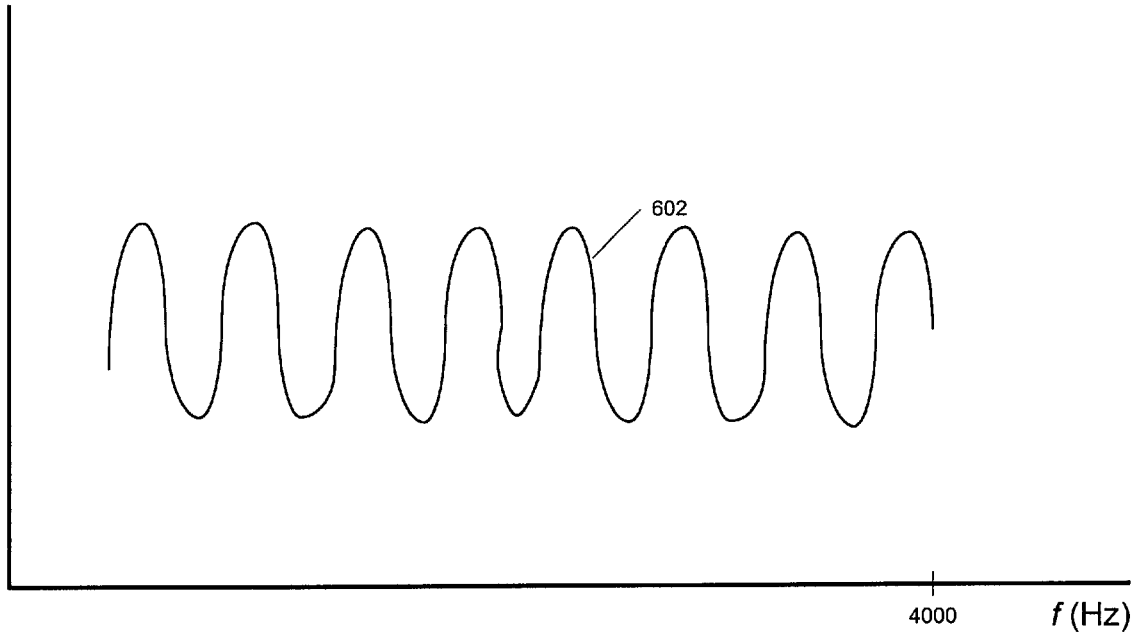
FIG. 6 is a graph illustrating the energy spectrum of a smooth, periodic signal created in the decoder illustrated in FIG. 4 by harmonic analysis and synthesis of the spectrum illustrated in FIG. 5.

Referring to FIG. 3, it can be seen that the spectrum (curve 304) of excitation signal $\mu(n)$, or $\mu_1(n)$ in FIG. 4, is flat relative to the spectrum of speech input s(n) (curve 302). In other words, due to the quantization of $\mu_1(n)$, curve 304 does not vary as much from maximum to minimum as curve 302. The spectrum 502 of excitation signal $\mu_1(n)$ is isolated in FIG. 5. In addition to being relatively flat, spectrum 502 is also relatively noisy. As a result, synthesized speech signal s'(n), produced by synthesis filter 412, does not sound as good as the original speech input s(n). In order to combat this problem, excitation signal $\mu_1(n)$ is passed through harmonic analysis and synthesis filter 404. Essentially, harmonic analysis and synthesis filter 404 looks at the peaks of spectrum 502 and then does a harmonic estimation and interpolation to synthesize a smooth, periodic signal h(n). The spectrum 602 of smooth, periodic signal h(n) is illustrated in FIG. 6.

In one sample embodiment, the harmonic analysis and synthesis performed by harmonic analysis and synthesis filter 404 is done using Prototype Waveform Interpolation (PWI). The perceptual importance of the periodicity in voiced speech led to the development of waveform interpolation techniques. PWI exploits the fact that pitch-cycle waveforms in a voiced segment evolve slowly with time. As a result, it is not necessary to know every pitch-cycle to recreate a highly accurate waveform. The pitch-cycle waveforms that are not known are then derived by means of interpolation. The pitch-cycles that are known are referred to as the Prototype Waveforms. PWI is often used in transmitters, and it is information related to the prototype waveforms that is transmitted to a decoder such as decoder 400.

PWI works extremely well for voiced segments, however, it is not applicable to unvoiced speech. Therefore, it always has to work with another method of speech coding, such as CELP, to handle the unvoiced segments. As a result PWI was refined to Waveform Interpolation (WI), which is capable of encoding voiced and unvoiced speech. Therefore, alternative embodiments of harmonic analysis and synthesis filter 404 utilize WI, which represents speech with a series of evolving waveforms. For voiced speech, these waveforms are simply pitch-cycles. For unvoiced speech and background noise, the waveforms are of varying lengths and contain mostly noise-like signals. The difference between WI and PWI is that evolving waveforms in WI are being sampled at much higher rates. The increased sampling rate does, however, come at the expense of an increased bit rate. To counter this problem, the waveforms are broken down into components that represent the smooth periodic portion of the speech signal and the remaining non-periodic and noise components. Harmonic analysis and synthesis filter 404 then uses these waveform components to produce the smooth spectrum 602 seen in FIG. 6.

In addition to smoothing out spectrum 502 and making it more periodic, harmonic analysis and synthesis filter 404 imparts a further benefit. As can be seen in FIG. 5, excitation signal $\mu_1(n)$ has very little energy in the higher frequency range. This is due to inherent limitations of encoders 100 and decoders 112 of the type illustrated in FIG. 1. Unfortunately, a high pass filter is not sufficient to even out the energy of spectrum 502 across the audio frequency band. In addition, it would not be beneficial to lose any voice information that resides in the lower half of spectrum 502. Especially because the lower half of spectrum 502 contains most of the periodic information that is very important for accurate voice reproduction. Therefore, a high pass filter is not a good solution to the energy drop-off at higher frequencies. Fortunately, the harmonic analysis performed by harmonic analysis and synthesis filter 404 forces spectrum 602 to be flat throughout the audio band. This is because harmonic analysis and synthesis filter 404 interpolates the amplitude and period information contained in $\mu_1(n)$ throughout the band. Thus, as can be seen in FIG. 6, spectrum 602 is flat, with no drop-off at higher frequencies.

The main disadvantage of performing the harmonic analysis on excitation signal $\mu_1(n)$ is that h(n) can actually be too smooths the result is an unnatural, buzzy sounding voice reproduction. On the other hand, excitation signal $\mu_1(n)$ is more natural sounding, but is noisier and plagued by high frequency loss. To obtain the best of both signals $\mu_1(n)$ and h(n), the two are combined proportionately. Therefore, modified excitation signal $\mu_2(n)$ is less noisy and avoids high frequency loss, due to the smooth, periodic nature of h(n), and is also more natural sounding due to the naturalness of excitation signal $\mu_1(n)$.

The two signals h(n) and $\mu_1(n)$ are proportionately added together by multiplying h(n) by a first gain factor ($\alpha$) in multiplier 406, where ($\alpha$) is between 1 and 0. Excitation signal $\mu_1(n)$ is then multiplied by a second gain factor ($1-\alpha$). The resulting products are then added in adder 410. Thus, ($\alpha$) provides adaptive control of the characteristics of modified excitation signal $\mu_2(n)$. The value of ($\alpha$) is chosen based on how smooth and periodic $\mu_1(n)$ is to begin with. For example, if very short interpolations are being performed by harmonic analysis and synthesis filter 404, then ($\alpha$) is smaller. This is because speech will appear to be more periodic over short time periods. If, however, the interpolations are longer, then ($\alpha$) should be increased. This is because speech will appear less periodic over longer periods.

Figure 1A:
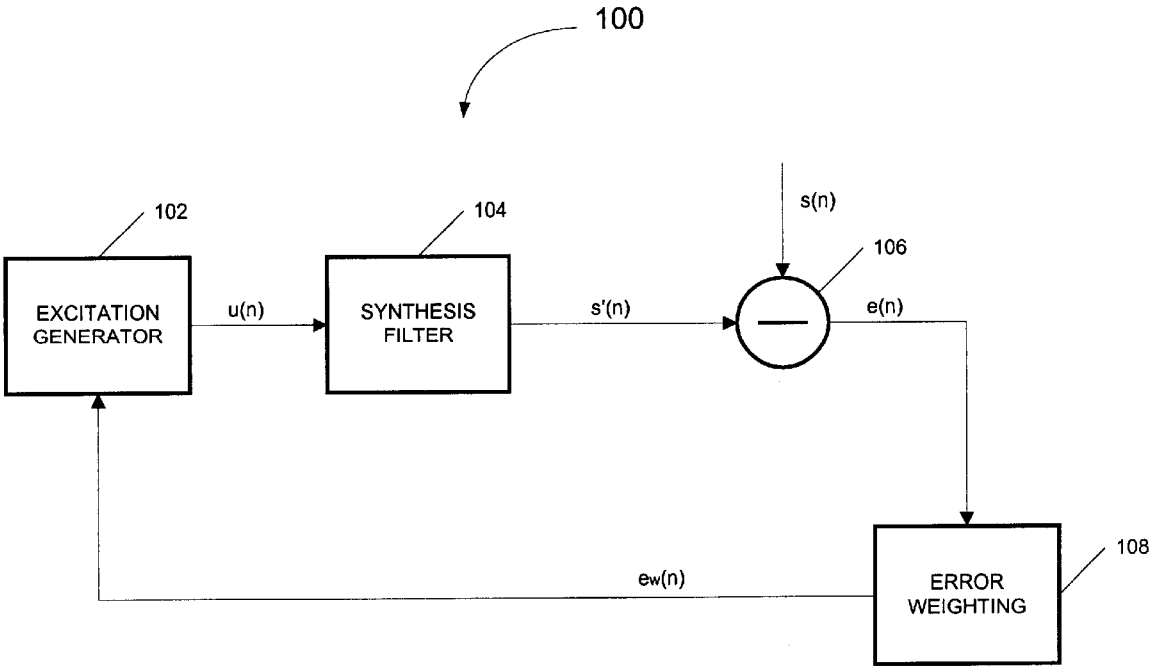
FIG. 1A is a block diagram illustrating a CELP encoder.
Figure 1B:
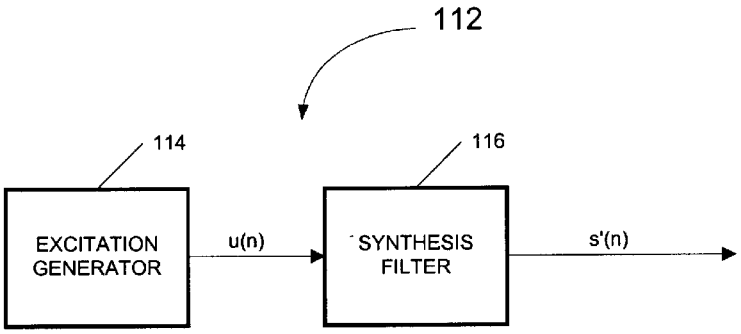
FIG. 1B is a block diagram illustrating a decoder that works in conjunction with the encoder of FIG. 1A.
Figure 2:
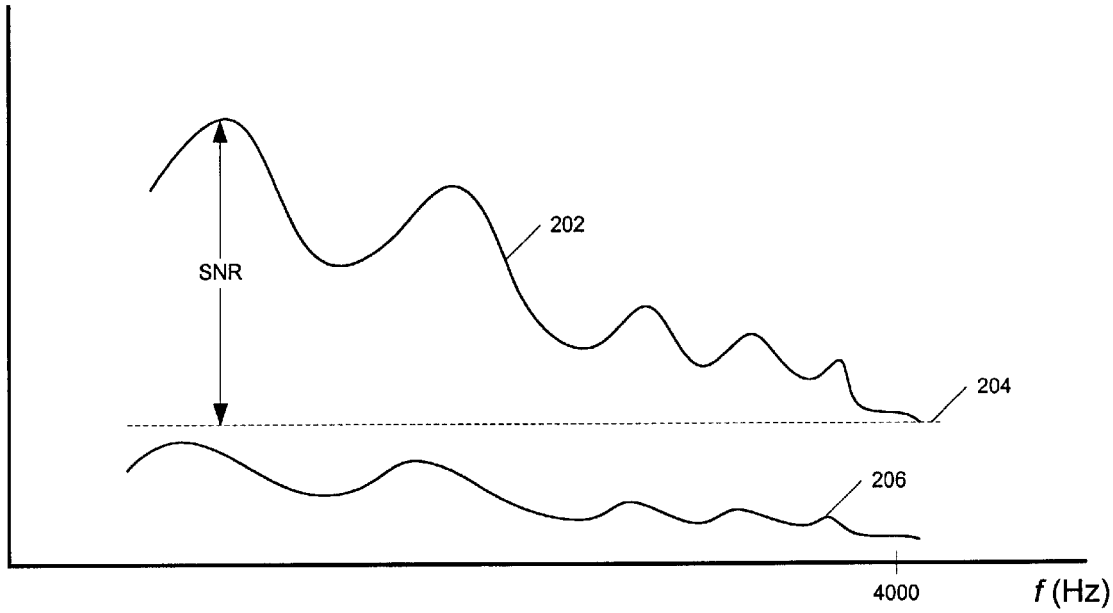
FIG. 2 is a graph illustrating the signal to noise ratio of a synthesized speech signal and a weighted error signal in the encoder illustrated in FIG. 1A.

Excitation generator 402 generates excitation signal $\mu_1(n)$ in accordance with information provided by an encoder such as encoder 100 in FIG. 1A. Other examples of encoders that can be used in conjunction with speech decoder 400 are discussed in co-pending U.S. patent Application Ser. No. 09/625,088, filed Jul. 25, 2000, titled "Method and Apparatus for Improved Error Weighting in a CELP Encoder," which is incorporated herein by reference in its entirety. Similarly, the parameters for synthesis filter 412 are provided by the encoder. Thus, excitation signal $\mu_1(n)$ may be generated from a codebook that contains a predetermined set of excitation signals. The information from the encoder tells decoder 400 which signal from the predetermined set to select. If the encoder uses an adaptive codebook to improve the estimation of the long-term periodicity, or pitch, then excitation signal $\mu_1(n)$ may be generated from signals selected from multiple codebooks. In one implementation, for example, $\mu_1(n)$ is generated from a signal selected from a short-term or fixed codebook and one selected from a long-term (adaptive) codebook. The two signals are typically multiplied by gain terms, provided by the encoder, then added together to form $\mu_1(n)$.

Figure 7:
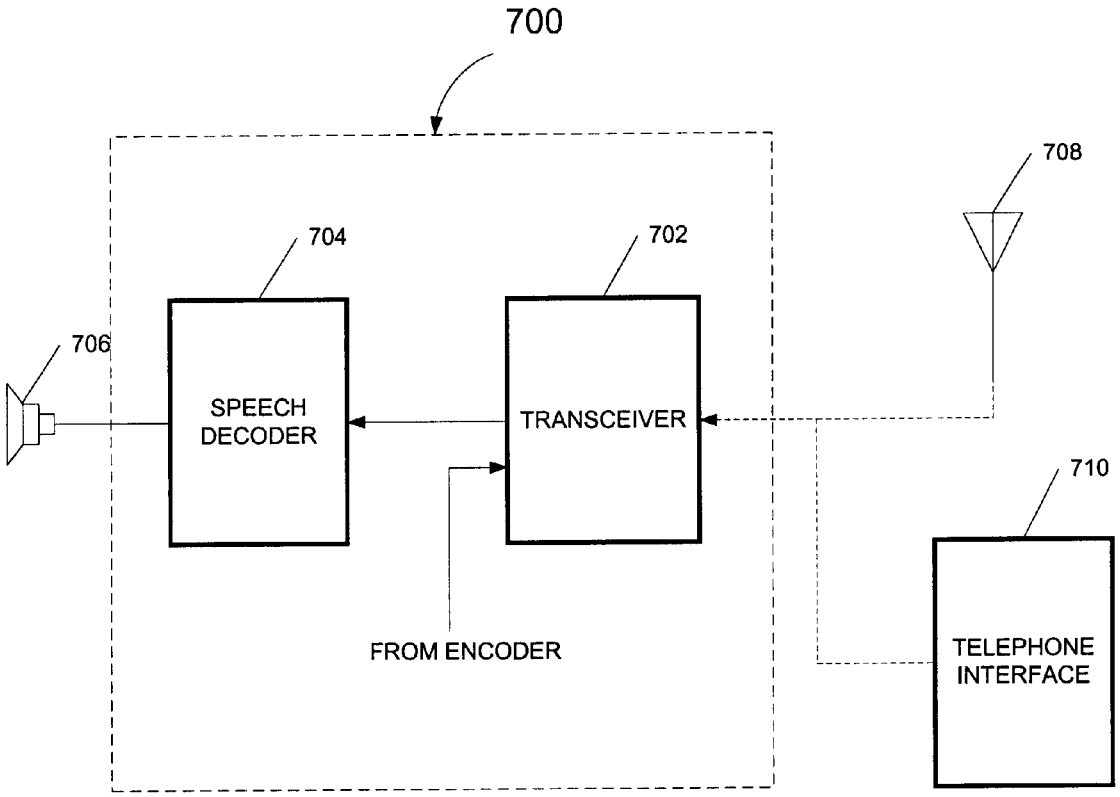
FIG. 7 is a block diagram of a transmitter that incorporates a speech decoder such as the decoder illustrated in FIG. 4.

There is also provided a receiver 700 as illustrated in FIG. 7. Receiver 700 comprises a transceiver 702 and a speech decoder 704. Transceiver 702 receives encoded speech information that is formatted for a particular transmission medium being employed. In one implementation, the transmission medium is an RF interface. In this implementation, transceiver 702 receives the encoded speech information via an antenna 708, which receives RF transmissions. In another sample implementation, transceiver 702 receives the encoded speech information via a telephone interface 710. Telephone interface 710 is typically employed, for example, when receiver 700 is connected to the Internet. Transceiver 702 removes the transmission formatting and passes the encoded speech information to speech decoder 704. Transceiver 702 also typically receives information from an encoder for transmission using antenna 708 or telephone interface 710. The encoder is not particularly relevant to the invention and, therefore, is not shown in FIG. 7.

Speech decoder 704 is a decoder such as speech decoder 400 illustrated in FIG. 4. Therefore, speech decoder 704 generates a synthesized speech signal s'(n). In a typical implementation, synthesized speech signal s'(n) is then communicated to a user through a listening device 706, which is typically a speaker.

Receiver 700 is capable of implementation in a variety of communication devices. For example, receiver 700 can be implemented in a telephone, a cellular or PCS wireless phone, a cordless phone, a pager, a digital answering machine, or a personal digital assistant device.

Figure 8:
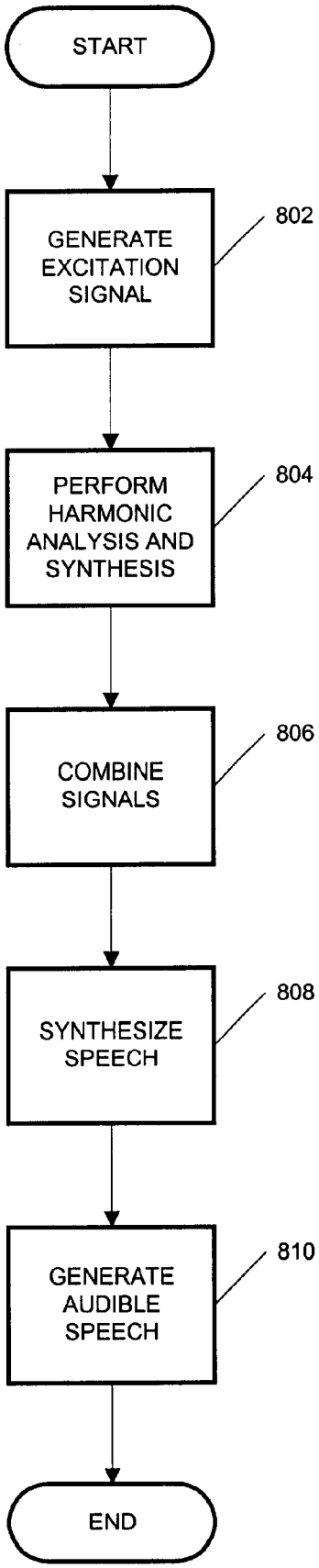
FIG. 8 is a process flow diagram illustrating a method of speech decoding in accordance with the invention.

There is also provided a method for speech decoding comprising the steps illustrated in FIG. 8. First, in step 802, an excitation signal is generated. In one sample implementation, this step comprises selecting the excitation signal from a codebook and multiplying the excitation signal by a selectable gain term. In another sample implementation, this step comprises selecting a plurality of codebook signals from a plurality of codebooks, multiplying each codebook signal by a selectable gain term, and adding the codebook signals to form the excitation signal.

Next, in step 804, harmonic analysis and synthesis is performed on the excitation signal in order to create a smooth, periodic speech signal. For example, such harmonic analysis and synthesis may be carried out by harmonic analysis and synthesis filter 404 illustrated in FIG. 4. In step 806, the excitation signal and the smooth, periodic signal are combined to form a modified excitation signal. In one sample implementation, this step comprises multiplying the smooth, periodic signal by a first gain term, multiplying the excitation signal by a second gain term that is equal to 1 minus the first gain term, and adding the resulting products to generate the modified excitation signal.

In step 808, the modified excitation signal is synthesized into a synthesized speech signal. For example, the synthesis may be carried out by synthesis filter 412 illustrated in FIG. 4. Then, in step 810, an audible speech signal is generated from the synthesized speech signal. Typically, this is performed by some type of listening device, such as listening device 706 in FIG. 7.

While various embodiments of the invention have been presented, it should be understood that they have been presented by way of example only and not limitation. It will be apparent to those skilled in the art that many other embodiments are possible, which would not depart from the scope of the invention. For example, in addition to being applicable in a decoder of the type described, those skilled in the art will understand that there are several types of analysis-by-synthesis methods and that the invention would be equally applicable in decoders implementing these methods.

What is claimed:

1. A speech decoder comprising:

a means for generating an excitation signal;

a means for performing harmonic analysis and synthesis on the excitation signal in order to generate a smooth, periodic speech signal;

a mixing means for mixing the excitation signal with the smooth, periodic speech signal in order to produce a modified excitation signal; and a synthesizing means for synthesizing the modified excitation signal into a synthesized speech signal that can be played to a user through a listening means.

2. The speech decoder of claim 1, wherein the excitation signal is selected from a predefined set of signals and multiplied by a selectable gain term.

3. The speech decoder of claim 1, wherein the excitation signal is generated by adding a plurality of signals selected from a plurality of predefined signal sets.

4. The speech decoder of claim 1, wherein the mixing means comprises:

a first multiplier means for multiplying the smooth, periodic speech signal by a first gain factor;

a second multiplier means for multiplying the excitation signal by a second gain factor that is inversely proportional to the first gain factor; and a means for adding the products of the first and second multiplier means in order to provide the modified excitation signal.

5. The speech decoder of claim 4, wherein the first gain term is greater than 0, but less than 1, and the second gain term is equal to 1 minus the first gain term.

6. A speech decoder comprising:

an excitation generator configured to generate an excitation signal;

a harmonic estimation and synthesis filter coupled with the excitation generator, said harmonic estimation and synthesis filter configured to perform a harmonic analysis of the excitation signal and to synthesize a smooth, periodic speech signal therefrom; and a mixing block coupled to the harmonic estimation and synthesis filter, said mixing block configured to combine the excitation signal with the smooth, periodic speech signal and to thereby generate a modified excitation signal; and a synthesis filter coupled with the mixing block, said synthesis filter configured to synthesize the modified excitation signal into a synthesized speech signal.

7. The speech decoder of claim 6, wherein the excitation generator comprises a codebook, said codebook configured to allow the excitation signal to be selected from said codebook, and a multiplier, said multiplier configured to multiply said excitation signal with a selectable gain term.

8. The speech decoder of claim 6, wherein the excitation generator comprises:

a plurality of codebooks, said plurality of codebooks configured to allow a codebook signal to be selected from each codebook;

a plurality of multipliers coupled to said plurality of codebooks, said plurality of multipliers configured to multiply each codebook signal by a selectable gain term; and an adder coupled to said plurality of multipliers, said adder configured to combine the codebook signals from the plurality of codebooks in order to form the excitation signal.

9. The speech decoder of claim 6, wherein the mixing block comprises:

a first multiplier coupled to the harmonic estimation and synthesis filter, said first multiplier configured to multiply the smooth, periodic speech signal by a first gain factor;

a second multiplier coupled to the excitation generator, said second multiplier configured to multiply the excitation signal by a second gain factor that is inversely proportional to the first gain factor; and an adder coupled to said first and second multipliers, said adder configured to add the products of said first and second multipliers in order to produce a modified excitation signal.

10. The speech decoder of claim 9, wherein the first gain term is greater than 0, but less than 1, and the second gain term is equal to 1 minus the first gain term.

11. A method for speech decoding comprising:

generating an excitation signal;

performing harmonic analysis on the excitation signal in order to generate a smooth, periodic speech signal;

mixing the excitation signal with the smooth, periodic speech signal in order to generate a modified excitation signal;

synthesizing the modified excitation signal in order to produce a synthesized speech signal; and generating an audible speech signal from the synthesized speech.

12. The method of claim 11, wherein generating the excitation signal comprises selecting the excitation signal from a codebook and multiplying the excitation signal by a selectable gain term.

13. The method of claim 11, wherein generating an excitation signal comprises:

selecting a plurality of codebook signals form a plurality of codebooks;

multiplying each codebook signal by a selectable gain term; and adding the codebook signal to form the excitation signal.

14. The method of claim 11, wherein mixing the excitation signal with smooth, periodic speech signal comprises:

multiplying the smooth, periodic speech signal by a first gain factor;

multiplying the excitation signal by a second gain factor that is inversely proportional to the first gain factor; and adding the products that result from the prior two steps to generate the modified excitation signal.

15. A receiver comprising:

an input means configured to receive an encoded transmission signal;

a transceiver coupled with the input means, said transceiver configured to decode, from the encoded transmission signal, parameters to be used to produce a synthesized speech signal;

a speech decoder coupled with the transceiver, said speech decoder configured to use the parameters to produce the synthesized speech signal, said speech decoder including:

an excitation generator configured to generate an excitation signal;

a harmonic estimation and synthesis filter coupled with the excitation generator, said harmonic estimation and synthesis filter configured to perform a harmonic analysis of the excitation signal and to synthesize a smooth, periodic speech signal therefrom; and a mixing block coupled to the harmonic estimation and synthesis filter, said mixing block configured to combine the excitation signal with the smooth, periodic speech signal and to thereby generate a modified excitation signal; and a synthesis filter coupled with the mixing block, said synthesis filter configured to synthesis the modified excitation signal into a synthesized speech signal; and a speaker coupled with said speech decoder, said speaker configured to create an audible voice signal from the synthesized speech signal.

16. The receiver of claim 15, wherein the mixing block comprises:

a first multiplier coupled to the harmonic estimation and synthesis filter, said first multiplier configured to multiply the smooth, periodic speech signal by a first gain factor;

a second multiplier coupled to the excitation generator, said second multiplier configured to multiply the excitation signal by a second gain factor that is inversely proportional to the first gain factor; and an adder coupled to said first and second multipliers, said adder configured to add the products of said first and second multipliers in order to produce a modified excitation signal.

17. The receiver of claim 15, wherein the input means is an antenna or a telephone line.

18. The receiver of claim 15, wherein said receiver is included in one of the following communication devices: a telephone, a cellular phone, cordless phone, a pager, a digital answering machine, or a personal digital assistant.

* * * * *